US005605332A

United States Patent [19]

Harnett

[11] Patent Number: 5,605,332

[45] Date of Patent: Feb. 25, 1997

[54] PIXELATED PUZZLE

[75] Inventor: Brian P. Harnett, Toronto, Canada

[73] Assignee: Pixel Products Unlimited, Toronto, Canada

[21] Appl. No.: 588,750

[22] Filed: Jan. 19, 1996

[51] Int. Cl.[6] ..... A63F 9/10

[52] U.S. Cl. ..... 273/157 R

[58] Field of Search ..... 273/153 R, 153 S, 273/156, 157 BA, 160; 446/120, 121, 124, 125, 127, 128

[56] References Cited

U.S. PATENT DOCUMENTS

| | | | |
|---|---|---|---|
| 2,037,966 | 4/1936 | Dailey | 273/157 R |
| 2,953,380 | 9/1960 | Hassenbach | 273/157 R |
| 3,987,558 | 10/1976 | Tsukamoto | 273/157 R X |
| 4,361,328 | 11/1982 | Stein et al. | 273/156 |
| 5,067,714 | 11/1991 | Rasberry | 273/157 |
| 5,296,845 | 3/1994 | Haller | 273/157 R X |
| 5,439,221 | 8/1995 | Harvie | 273/157 R |

FOREIGN PATENT DOCUMENTS

| | | | |
|---|---|---|---|
| 891705 | 4/1982 | Belgium . | |
| 1142193 | 3/1983 | Canada . | |
| 2537449 | 6/1984 | France . | |
| 3502581A1 | 5/1986 | Germany . | |
| WO02341 | 7/1982 | WIPO | 273/157 R |
| WO89/04705 | 6/1989 | WIPO . | |

OTHER PUBLICATIONS

Anne D. Williams, *Jigsaw Puzzles: An Illustrated History and Price Guide* (Radnor: Wallace–Homestead, 1990) at 84–85, 166–167, 206b–206c, 218–219, 260–261 274–275, 302–305, 324–325.

Linda Hannas, *The Jigsaw Book* (New York: Bellew & Higton Publishers Ltd., 1981) at 66–67.

*Bits & Pieces: The Great International Puzzle Collection*, Fall 1995, at 1, 3, 15–16, 20, 31, 33, 39, 40, 41, 42, 45, 56.

Milton Bradley Company, Mosaic™ puzzle, ©1988 Charles Wysocki.

*Primary Examiner*—William H. Grieb

*Attorney, Agent, or Firm*—Bereskin & Parr

[57] ABSTRACT

A jigsaw puzzle having a pixelated image, capable of being assembled into a plurality of arrangements for added difficulty, or to create original artistic images. The puzzle has a plurality of engaging inner pieces, each identically shaped and sized, and having a plurality of edges, wherein each pair of adjacent edges meets at a right angle. The edges of each piece are aligned with the pixel configuration. This puzzle may also be displayed and assembled on a computer screen using a pointing device such as a mouse.

29 Claims, 8 Drawing Sheets

PIXELATED PUZZLE

FIELD OF THE INVENTION

This invention relates to jigsaw puzzles.

BACKGROUND OF THE INVENTION

Jigsaw puzzles have been available in a variety of forms for over two centuries. The typical jigsaw puzzle involves an image on a sheet of suitable material such as cardboard or wood, which is cut into a plurality of various shaped and sized pieces. In reconstructing the image from the pieces, an individual compares the various clues to the puzzle's solution including the shape of the puzzle pieces, and the colour and design of the image on the puzzle pieces.

Recently, variations from the conventional approach to jigsaw puzzles has resulted in renewed interest and sales of puzzles. For example, puzzle designers have increased the difficulty of assembling a puzzle by removing one or more of the clues to its solution. One such puzzle displayed a uniform colour, thereby removing both colour and design as potential clues to its solution. Canadian Patent No. 1,142,193 shows a puzzle in which each of the puzzle pieces is identically shaped in the outline of a lizard or some other animal, and which is capable of numerous different solutions. However, the pieces are only connectible in certain limited ways; thus 3 pieces are connected together at the heads of the lizard shapes to form a cluster, and the clusters can then be arranged in various ways.

U.S. Pat. No. 5,067,714 discloses a variable arrangement floral design jigsaw puzzle in which the inner pieces of the puzzle are of three different shapes. Each side of each of the inner piece shapes is capable of interlocking with any side of any other inner piece, thereby creating multiple different solutions. Each inner piece displays either background or floral images. This reference shows a puzzle which can be used to create artistic floral designs.

Recently, significant consumer interest has developed for puzzles in which the various shaped pieces interlock to form a three dimensional structure, as disclosed in Canadian Patent 2,650,969. However, on any one surface of the puzzle, the pieces interlock in the manner of a conventional puzzle.

The Milton Bradley Company, U.S.A., has marketed a puzzle under the trade mark MOSAIC, in which all the inner pieces have straight edges, which are orthogonal to one another. A frame is provided, in which the pieces interlock in the manner of a conventional puzzle, to hold all the inner pieces in place. However, all the pieces are essentially of different configuration and most are not symmetrical. At least if there is any repetition of individual shapes it is not enough to permit the pieces to be rearranged readily to create an artistic effect. The image on the pieces is conventional. The pieces are cut so as not to provide any significant frictional engagement, and hence the need for the edge pieces to hold them all together. Further, the pieces are partially cut through on square grid, to create the mosaic effect. The edges of the inner pieces also fall on this square grid. With the exception of one or two pieces, most pieces do not interlock.

Computerized puzzles have also been developed in which images of the various puzzle pieces are displayed on the computer screen, and are selected and moved into position on the screen using some form of pointing device, such as a mouse, although often the pieces can only be moved horizontally and vertically and are not capable of being rotated.

German Patent No. 3,502,581 discloses a puzzle displaying a computer generated image with pixels having a limited number of colours. The computer then generates an image corresponding to the original image, for each colour, in which only the pixels of that colour are displayed. It is these individual colour images that are put onto transparent puzzle pieces. The pieces for all of the individual colour images are then stacked to generate the complete pixelated image.

It is desirable to provide a jigsaw puzzle which provides added difficulty by eliminating puzzle piece shape as a clue to the solution of the puzzle. It is also desirable to provide a jigsaw puzzle which permits multiple original artistic arrangements of the pieces as determined solely by the user. It is further desirable to provide a jigsaw puzzle which provides added difficulty by reducing or eliminating the image on the individual puzzle pieces as a clue to the puzzle's solution.

It is also desirable to provide a jigsaw puzzle in which the nature of the image is unknown to the user until the puzzle is substantially complete.

SUMMARY OF THE INVENTION

In accordance with the present invention, there is provided a jigsaw puzzle comprising a plurality of inner pieces and bearing an image which has been pixelated, and which comprises a plurality of pixels arranged on a grid defined by a plurality of sets of parallel lines which sets of lines intersect one another, wherein each inner piece comprises an integral number of pixels whereby each pixel is located solely on a single inner piece and edges of each inner piece comprise portions of said lines. Preferably, the inner pieces include at least one tab and at least one recess. More preferably, each tab and recess comprises at least three line portions which are continuous with each other, and wherein, for each tab and recess, each adjacent pair of line portions comprise portions from different sets of lines.

In this specification, including the claims, reference to pixels is a reference to pixels of any known form. Pixels may be any shape which will enable a complete image to be formed. The pixels can be square, triangular, hexagonal and other shapes. Preferably, the pixels are of a size that is immediately apparent and visible to a user, e.g. with a size in the range of 1.5–4 mm, with the exact size depending on the size of the puzzle and the size of the individual pieces and the nature of the image. Each pixel has a colour, brightness and intensity determined by averaging these properties over the corresponding area of an original image. This can be represented in the pixel by a continuous colour. Each individual pixel can also be formed in any known manner, and can comprise, for example a plurality of subpixels or dots; each subpixel or dot can then have its own parameters varied and/or can be present or omitted to obtain the desired overall effect for the complete pixel. The pixels can present a full colour image or a black and white image.

In a preferred aspect of the invention, each piece is generally square, and more preferably they are essentially identical to one another. Each side of each piece can then be complementary either to an adjacent side, in one variant, or to an opposite side, in another variant. In either case this can provide a strong interlocking effect when a piece is engaged, on at least two adjacent sides, with other pieces, which prevents that piece being removed by a simple sliding action.

By making the pieces identical in shape, the characteristic of shape is removed as a clue for solving the puzzle. If each piece only displays a relatively small number of pixels, then the image content of each piece is reduced to a level where it also is removed as a clue in helping to solve the puzzle. In effect, just the colour and pixels present in each piece are useful as clues and assisting in solving the puzzle. If there is no image present on a piece, then the user has to rely on just the colours of the pixel, which enhances the difficulty of the puzzle and makes it more interesting and challenging. The colours of pixels on a given piece may provide a general clue to the piece's general location in the puzzle.

With identical sized and shaped pieces, the pieces may be assembled to display a "solved" image, or may be arranged to display an original artistic image. The "solved" image may be revealed to the user to assist in the completion of the puzzle, or may be kept from the user such that the "solved" image is not apparent to the user until the puzzle is substantially complete. Additionally, the pieces may be packaged solely for the purpose of creating original artistic images without there being an intended "solved" image.

In another aspect, the present invention provides a jigsaw puzzle capable of being assembled into a plurality of different arrangements. The puzzle comprises a plurality of inner pieces adapted to engage one another, wherein the inner pieces are square and are of the same size and comprise a plurality of straight edge portions, wherein the inner pieces comprise first sides and second sides complementary to the first sides, and wherein each inner piece includes at least one first side and at least one second side, whereby the first side of any one inner piece can be engaged with a second side of any other inner piece.

Both aspects of the invention, outlined above may be embodied in a computer system for displaying and solving an image of a jigsaw puzzle. The computer system comprises display means for displaying an image of a plurality of jigsaw puzzle pieces, processing and memory means for storing and processing information on the jigsaw puzzle, and input means for facilitating and moving images of the jigsaw puzzle pieces. Many puzzles may be stored on floppy disks or CD ROMs. Puzzle data may also be accessed through the Internet. The input means can comprise a mouse or tracking ball device, enabling individual pieces to be moved on a display screen. The computer preferably includes a facility to store partially completed puzzles, for later completion, and means to enable puzzles of different complexity to be provided. The computer can provide for different levels of pixelation, to provide different degrees of difficulty, and can also enable different sized pieces to be provided. The computer could also provide a program for forming a pixelated puzzle with pixel and piece sizes selected by a user, for any image inputed by a user.

While this invention is intended to be mainly applicable to more conventional puzzles, it is to be appreciated that the technique is applicable to a number of different products and articles. For example, it could be applied to a variety of games, comic strips, post cards, greeting cards and the like.

Further aspects of the invention will appear from the following description, taken together with the accompanying drawings.

BRIEF DESCRIPTION OF THE DRAWINGS

The present invention will now be described, by way of example only, with reference to the following drawings, in which.

DETAILED DESCRIPTION OF THE PREFERRED EMBODIMENT

Figure 1A:
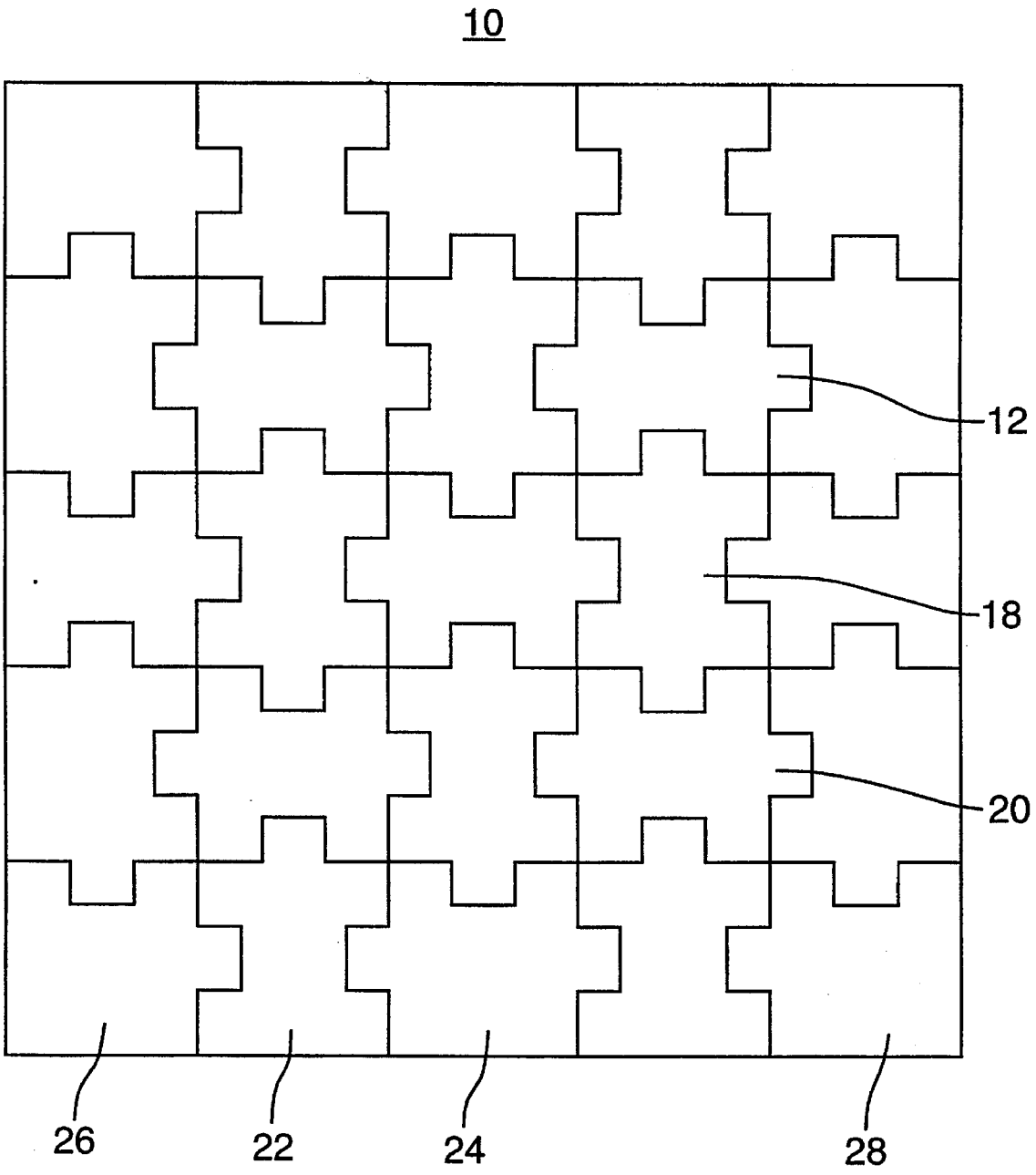
FIG. 1*a* is a top view of an embodiment of an assembled puzzle in accordance with the subject invention.
Figure 1B:
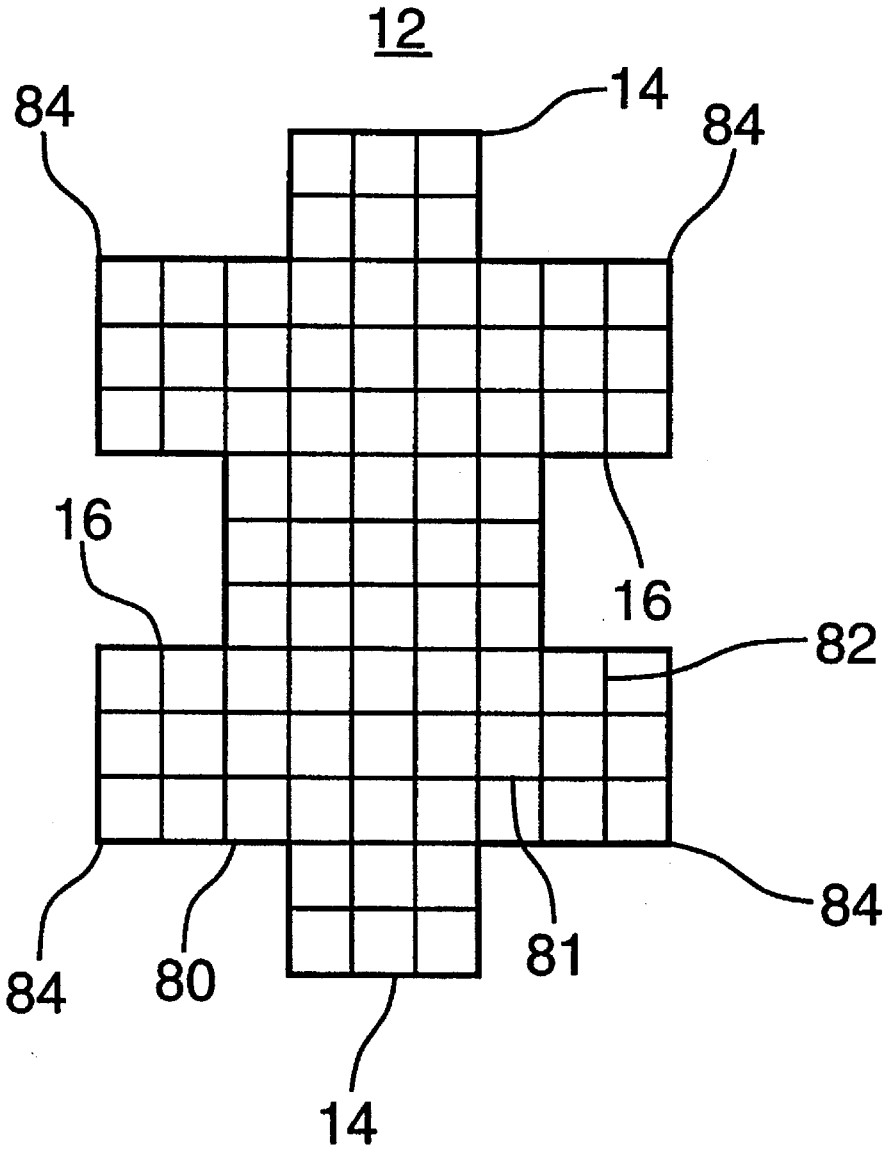
FIG. 1*b* is a top view of one puzzle piece from the puzzle of FIG. 1*a;*

Reference is first made to FIG. 1*a* which shows an assembled puzzle 10 according to the invention, and FIG. 1*b* which shows a single inner piece 12. Each inner piece 12 is identical in size and shape, and in this preferred embodiment is in the form of a double cross. The edges of each inner piece 12 are straight, with every adjacent edge meeting at a right angle. Each inner piece 12 has tabs 14 and recesses 16 which have corresponding right angle edges and dimensions to permit engagement of the inner pieces 12. Each inner piece 12 is symmetrical about both the horizontal and the vertical axes.

As shown, the piece 12 comprises an integral number of pixels 80. The pixels 80, in known manner are defined by a matrix or array of horizontal lines 81 and vertical lines 82. Each pixel 80 is thus present solely on just one piece 12.

Here, the piece 12 is best considered to have the shape of a square, with the corners 84 being corners of the square. The squares then fit together to form a complete image. The piece 12 has top and bottom tabs 14 projecting from the top and bottom of the square, and corresponding recesses 16 are set in from the sides of the square. In this embodiment, it is accordingly necessary for the pieces 12 to be aligned, alternately, vertically and horizontally, in each vertical and horizontal row, as shown in FIG. 1*a*. It is further to be appreciated that it is not essential for both top and bottom tabs 14 to have identical dimensions, nor for the recesses 16 to have identical dimensions. What is simply required is that each top tab 14 correspond to one of the recesses 16. Thus, one pair of a recess 16 and tab 14 could be shaped to comprise, for example, a square of 3×3 pixels, rather than the rectangular 3×2 pixel shape shown. However, it is preferred for the piece to be symmetrical about the horizontal and vertical axes, to provide a greater degree of difficulty for the user.

It can also be noted that each tab 14 comprises a pair of vertical line portions and a horizontal line portion, while each recess 16 correspondingly comprises a pair of horizontal line portions and a vertical line portion. The configuration of the tabs and recesses shown permits engagement of the pieces, but not full interlocking, in the sense that the pieces can be slid into an outer engagement while in a common plane. Complete interlocking is achieved in a full puzzle, since engagement with two adjacent pieces prevents one piece from being slid out of position. Interlocking can be provided, as for conventional jigsaw puzzles, by, in effect, undercutting the tabs 14. Thus, the free end of the tabs 14 could, in width, have a greater number of pixels than their roots adjacent the main body of the piece 12; the recesses 16 would then have a corresponding profile. Then, the pieces 12 could only be engaged by displacing one piece perpendicularly to the plane of the pieces. Here, the pieces 12 are preferably cut so as to provide for certain amount of interference or frictional fit, to give a certain interlocking effect.

In this specification including the claims, reference to pixels indicates a generally square area of uniform colour. However, many forms of pixels are known which can be used to create images. The size, shape, colour and intensity of each pixel may vary such that in combination the pixels create the desired effect. Square pixels are preferred, with dimensions in the range of 1.5 mm to 4.0 mm. Colour brightness information can be provided in any known manner within each pixel. For example, each pixel could itself comprise a matrix of dots or subpixels, each of which could be varied as required or a varying number of them could be present to provide the required colour and other information. The effect of gradations of colour and texture are provided, in known manner, by variation of these parameters across a large number of pixels. A close examination of a relatively small number of pixels, as on a single puzzle piece may give little clue as to the particular part of an image shown. This is expected to provide a greater degree of difficulty in assembling the puzzle; in effect, the usefulness of the image in determining the location of each piece is reduced or eliminated. In a conventional puzzle with a quality, colour image, quite small details can be present on a single piece, often giving a precise indication as to where the piece should be placed. Here, in the present invention, the image can be such that, only when a number of pieces have been put together does the user get any sense as to the portion of the image that they represent.

In an assembled puzzle, each inner piece 12 is aligned vertically 18 or horizontally 20, as shown in FIG. 1. Each vertically aligned inner piece 18 and each horizontally aligned inner piece 20 may be rotated 180°, thereby providing four possible alignments for each piece, while still permitting engagement. Multiple arrangements of the inner pieces 12 are possible, adding to the complexity of solving puzzle 10. A row of engaged inner pieces 12 requires alternating vertically aligned inner pieces 18 and horizontally aligned inner pieces 20.

Puzzle 10 is also provided with two different forms of outer or edge pieces 22, 24, each having a straight outer edge shaped to engage with inner pieces 12, and two different forms of corner pieces 26, 28 shaped to engage with outer pieces 22, 24 and having two straight outer edges. In a puzzle with an even number of pieces to a side, the two corner pieces on that side would be identical in size and shape, and would either be in the shape of corner piece 26 or corner piece 28.

With regard to the size of the tabs 14, as shown, it is preferred for these to be generally short, i.e. to have a width greater than their length. Practical sizes for the tabs 14 have been with a width that is one or two pixels greater than their height or length, which is visually more attractive and structurally more robust. The following dimensions, given by the number of pixels with the width dimension first, have found to be suitable: 3×2 (as in FIG. 1*b*); 4×3; 5×3; 5×4; 6×4.

Figure 2:
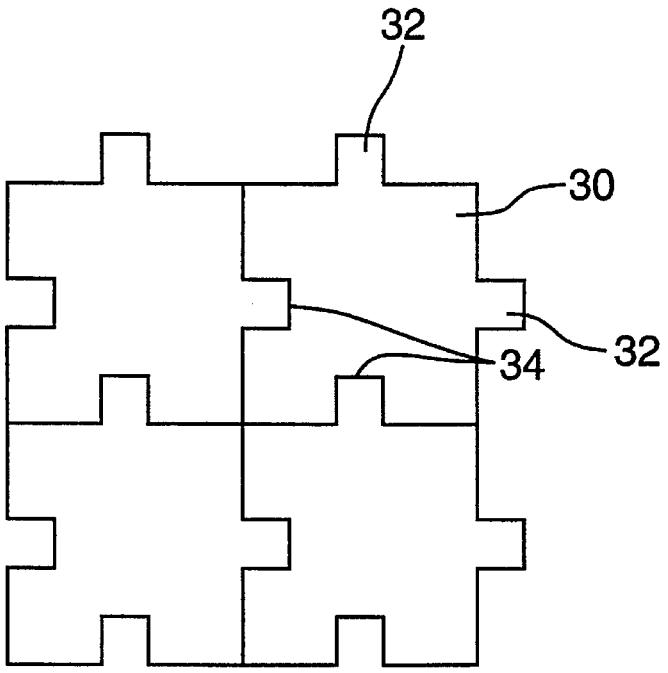
FIG. 2 is a top view of another embodiment of puzzle pieces in accordance with the subject invention.

FIG. 2 shows an alternate configuration for inner pieces 30 which engage and which are identical in size and shape. The edges of each inner piece 30 are straight, with every adjacent edge meeting at a right angle. Each inner piece 30 has one tab 32 on two adjacently positioned sides, and one recess 34 on the remaining two adjacently positioned sides. These tabs 32 and recesses 34 have corresponding right angle edges to permit engaging of the inner pieces 30.

Figure 3:
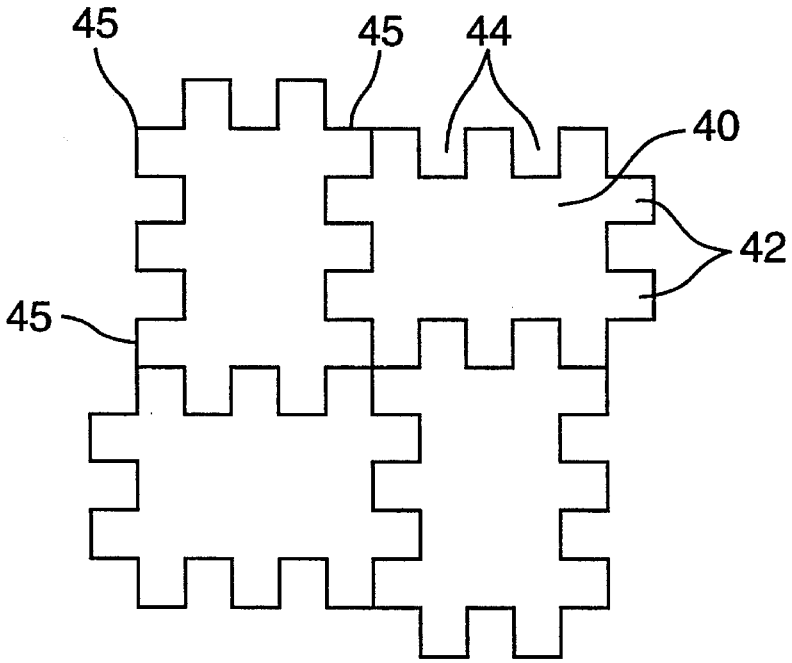
FIG. 3 is a top view of a further embodiment of puzzle pieces in accordance with the subject invention.

FIG. 3 shows an alternate configuration for inner pieces 40 which engage and which are identical in size and shape. The edges of each inner piece 40 are straight, with every adjacent edge meeting at a right angle, and again each piece is essentially square as defined by corners 45. Each inner piece 40 has two tabs 42 on one set of opposed sides, and two corresponding recesses 44 on the remaining set of opposed sides. These tabs 42 and recesses 44 have corresponding right angle edges to permit engagement of the inner pieces 40.

Figure 4:
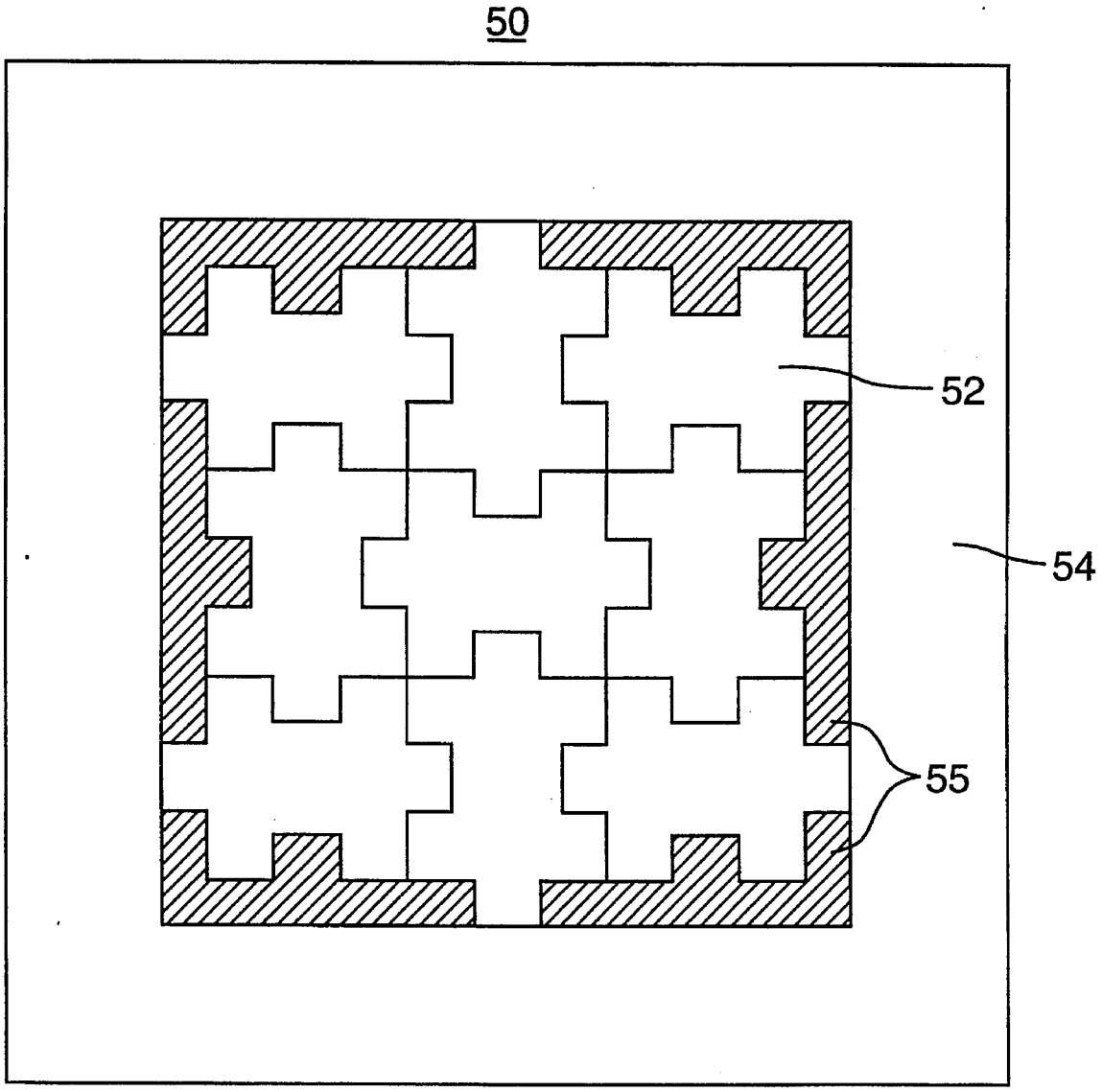
FIG. 4 is a top view of an assembled puzzle having a frame tray in accordance with the subject invention.

Referring now to FIG. 4, in an alternative embodiment, puzzle 50 has identically sized and shaped inner pieces 52. Frame tray 54 is shaped to engage with inner pieces 52, and has straight outer edges. The advantage of this embodiment is that it permits all of the actual puzzle pieces 52 (not considering the frame tray 54) to be identical in size and shape, without the need for outer pieces. Additionally, if the image displayed by the completed puzzle is not provided to the user, clues to the puzzle's solution may be provided by a portion of the image extended and displayed on the frame tray 54. Frame tray 54 may have a pixelated image over the entire surface of the frame portion or alternatively may have a pixelated image displayed on only small segments of the frame surface as depicted by shaded portions shown generally as 55, the shaded portions being dimensioned to be wide enough to include the outer tabs 42. Additionally, the tray portion of frame tray 54 may display outlines of the puzzle pieces illustrating how inner pieces 52 are oriented to engage with frame tray 54.

Figure 5A:
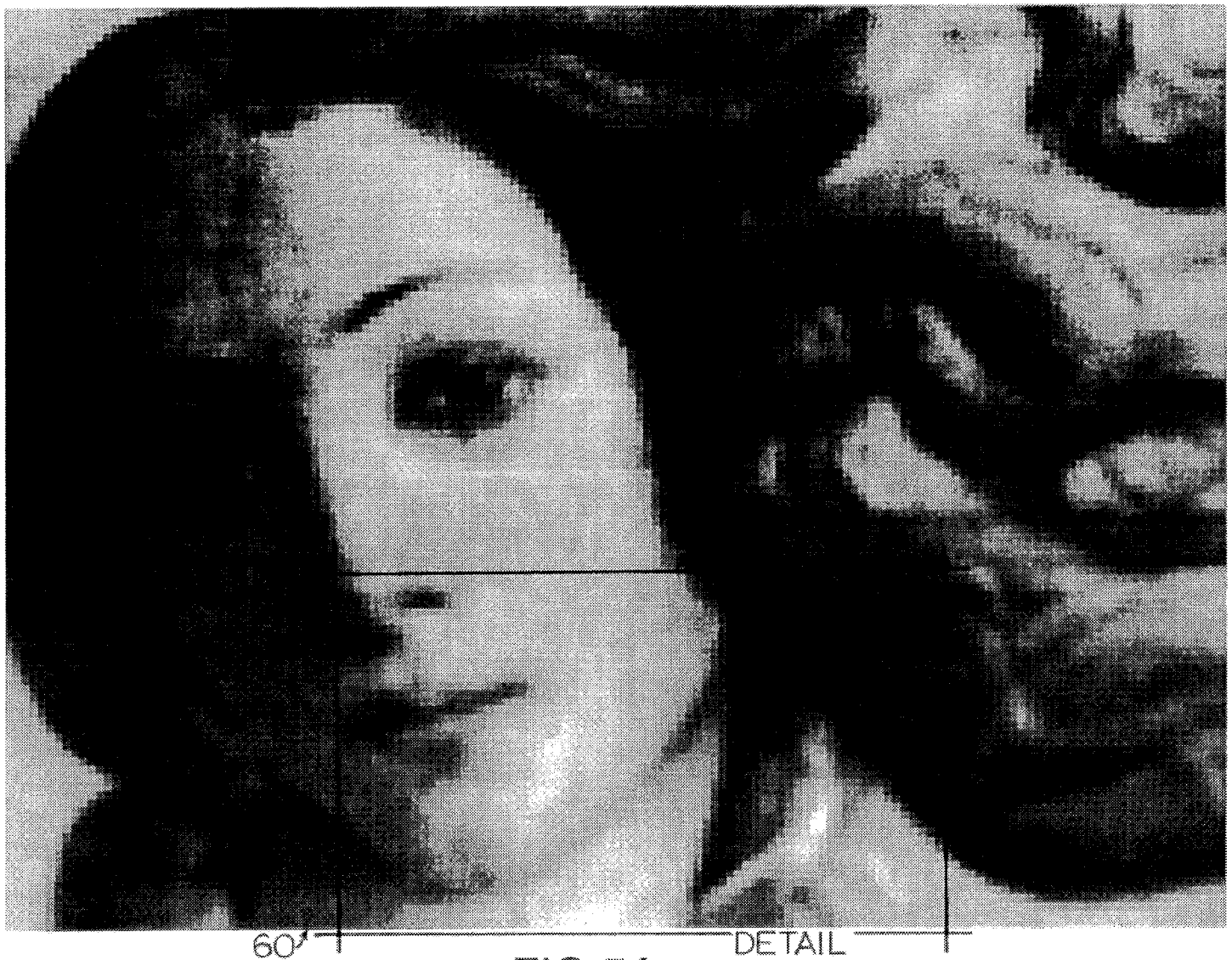
FIG. 5*a* is a top view of a puzzle having a pixelated image in accordance with the subject invention.
Figure 5B:
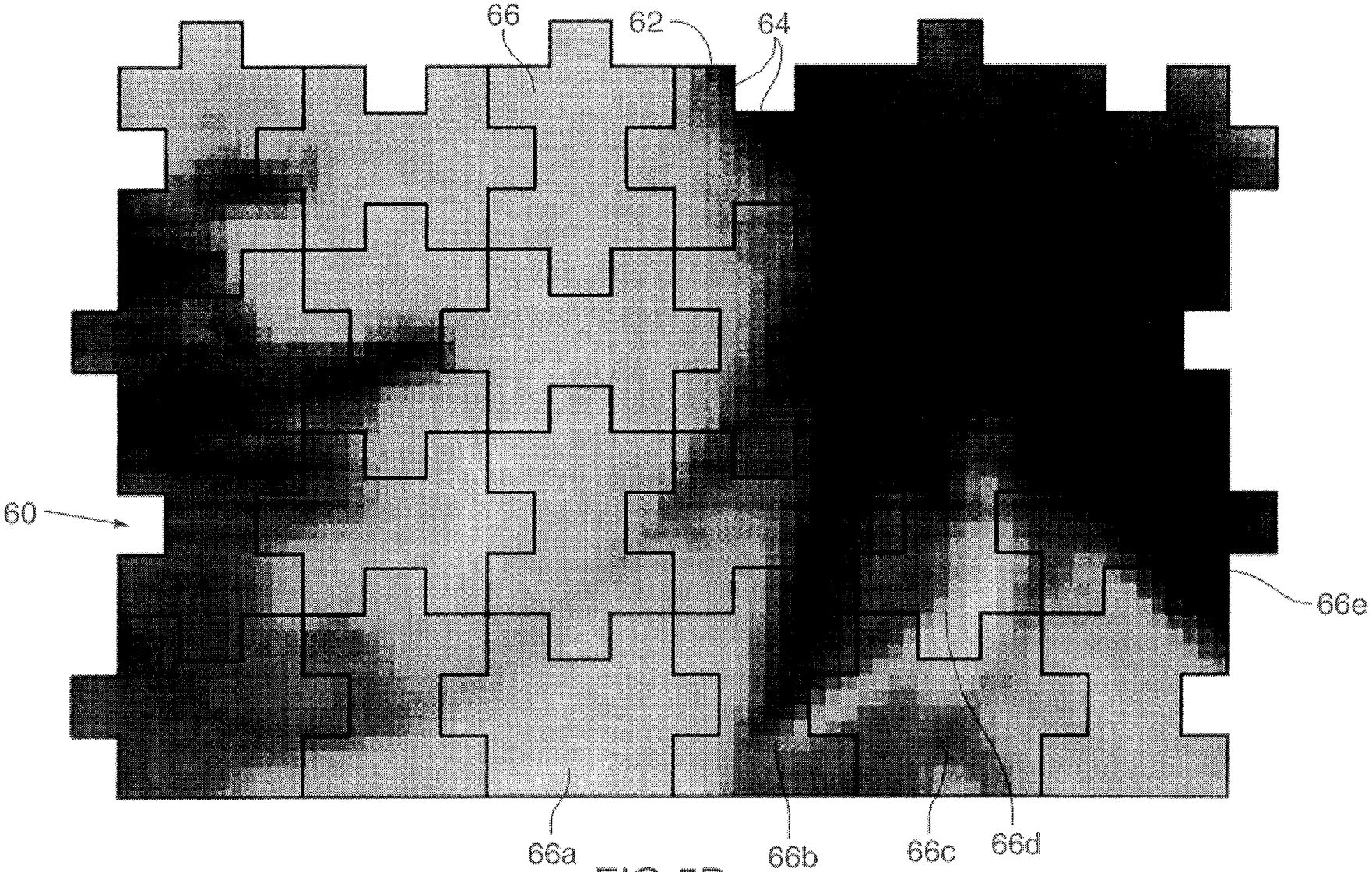
FIG. 5*b* is a detail from the puzzle of FIG. 5*a;*

FIGS. 5*a* and 5*b* show the preferred embodiment of puzzle 60 displaying a pixelated image 62. Image 62 is composed of individual pixels 64 arrayed in matrix rows both horizontally and vertically. Pixels 64 are typically of various colours, with each pixel being uniform throughout, but may be of various shades of grey ranging from black to white. Puzzle 60 contains a plurality of pieces 66. The edges of each piece 66 are straight, with every adjacent edge meeting at a right angle. The edges of each piece 66 are parallel to the horizontal and vertical linear arrangement of the pixels 64, and do not bisect the pixels 64. Pixelated image 62 is typically computer generated by scanning an image using a scanner connected to a computer and pixelating the image through known image transforming techniques, e.g. simply averaging chrominance and luminance values in the area corresponding to each pixel.

Figure 6:
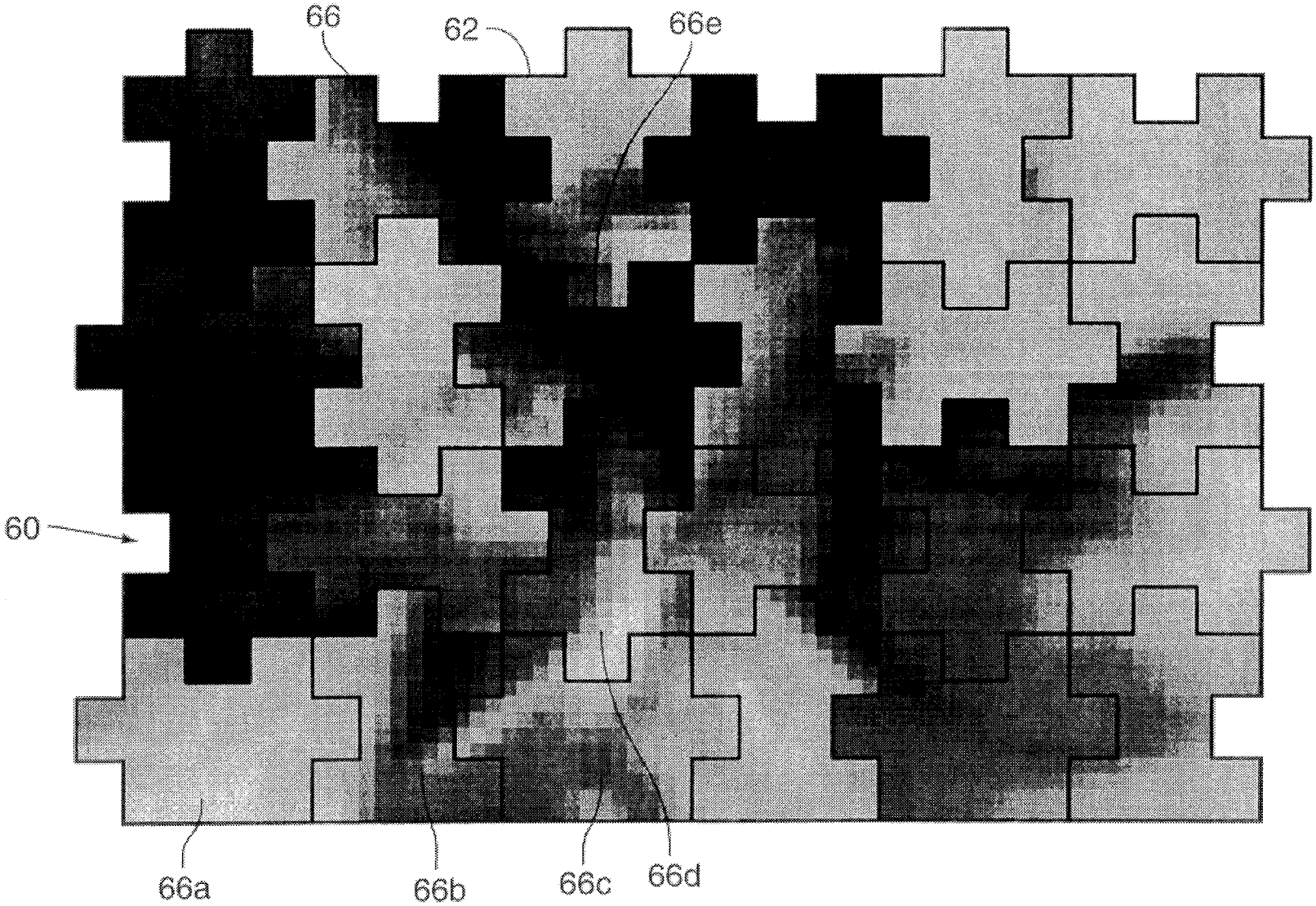
FIG. 6 is a top view of the puzzle detail of FIG. 5*b* with the pieces rearranged to create an artistic effect.

FIG. 6 shows the puzzle 60 and pieces 66 of the detail of FIG. 5*b* rearranged such that the pixelated image 62 displayed by the assembled puzzle 60 is altered to create an original abstract artistic effect. For illustrative purposes, pieces 66*a*, 66*b*, 66*c*, 66*d* and 66*e* in FIG. 5*b* correspond to reorganized pieces 66*a*, 66*b*, 66*c*, 66*d* and 66*e* in FIG. 6.

Figure 7:
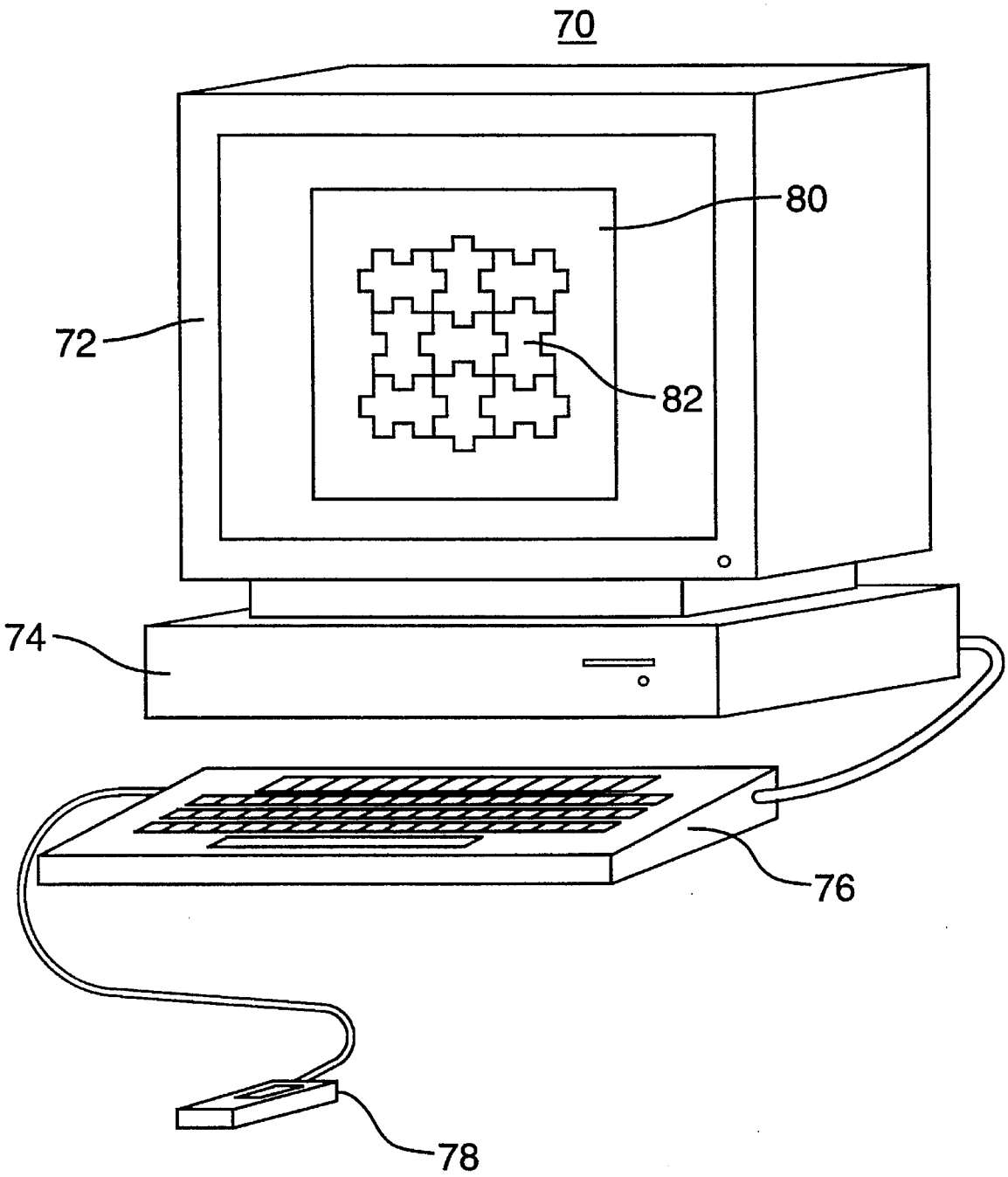
FIG. 7 is a perspective view of a computer system displaying a puzzle in accordance with the subject invention.

Referring now to FIG. 7, in a further alternative embodiment, typical computer system 70 is provided with a computer screen 72, processing and storage unit 74, keyboard 76, and a mouse pointing device 78. Displayed on computer screen 72 is an image of a puzzle 80 having images of inner pieces 82 which engage and which are identical in size and shape. Puzzle image data may be stored on CD ROM or floppy disks. Typically, image of puzzle 80 will itself display a pixelated image as shown in FIGS. 5 and 6. The pixels of such a pixelated image should typically be larger than the pixels of a typical computer screen 72, which commonly are so small as not to be readily detectable by the naked eye. The edges of all images of inner pieces 82 are straight, with every adjacent edge meeting at a right angle. Images of inner pieces 82 are capable of being repositioned and reoriented on computer screen 72 using mouse 78. Reorientation could be achieved by setting certain keys to effect rotation of a piece through 90° clockwise or counter clockwise, or by providing "buttons" on the screen for the same purpose.

It should be understood that although certain shapes of engaging puzzle pieces have been shown which are identical in size and shape and the edges of which are straight, with every adjacent edge meeting at a right angle, numerous other configurations for such pieces are possible.

It should also be understood that the size and shape of the pixels may be altered without departing from the subject invention. The size and shape of the pieces relative to the size of the pixels may also be varied without departing from the subject invention. The pieces could be rectangular, or of other quadrilateral shape.

It should be further understood that although the puzzle of the subject invention has been shown and described as having the shapes of the pieces and pixels corresponding to two orthogonal sets of parallel lines, other configurations are possible, for example, using three sets of parallel lines defining generally triangular shaped pixels. Then, the basic piece shape could be a triangle, parallelogram or hexagon.

Thus, while what is shown and described herein constitute preferred embodiments of the subject invention, it should be understood that various changes can be made without departing from the subject invention, the scope of which is defined in the appended claims.

I claim:

1. A jigsaw puzzle comprising a plurality of inner pieces each adapted to engage at least one other inner piece and together bearing a complete solved image which has been pixelated, and which comprises a plurality of pixels arranged on a grid defined by a plurality of sets of parallel lines which sets of lines intersect one another, wherein each inner piece comprises a plurality of said pixels and wherein edges of each inner piece comprise portions of said lines whereby each pixel is located solely on a single inner piece.

2. A jigsaw puzzle as claimed in claim 1, wherein each inner piece includes at least one tab and at least one recess.

3. A jigsaw puzzle as claimed in claim 2, wherein each tab and recess comprises at least three line portions which are continuous with each other and wherein adjacent line portions meet at an angle and wherein, for each tab and recess, each adjacent pair of line portions comprises portions from different sets of lines.

4. A jigsaw puzzle as claimed in claim 3, wherein each inner piece includes a plurality of tabs and a plurality of recesses and comprises a plurality of sides, each side comprising a line portion from one of said sets of lines with the tabs and recesses extending from the sides of each piece, wherein each side of each piece is complementary to at least one other side of that piece.

5. A jigsaw puzzle as claimed in claim 4, wherein the inner pieces are defined by a set of horizontal lines and a set of vertical lines, and wherein each piece is generally rectangular.

6. A jigsaw puzzle as claimed in claim 5, wherein each inner piece is generally square, and wherein each side is complementary to one of an adjacent side and an opposite side.

7. The jigsaw puzzle of claim 6, wherein each piece is symmetrical about horizontal and vertical axes and each side is complementary to an adjacent side.

8. The jigsaw puzzle as claimed in claim 7, wherein each tab and each recess is generally rectangular and has a width greater than its height.

9. The puzzle of claim 1 comprising at least one framing piece having at least one straight outer edge.

10. The puzzle of claim 9, wherein the framing piece comprises a frame tray shaped to engage with at least one inner piece.

11. The puzzle of claim 9, wherein the framing piece comprises a plurality of outer pieces having a plurality of edges, wherein each pair of adjacent edges meets at an angle, and wherein each outer piece has one straight outer edge.

12. The puzzle of claim 11, wherein the outer pieces comprise a plurality of first outer pieces and a plurality of second outer pieces, wherein said first outer pieces are identically shaped and sized, and wherein said second outer pieces are identically shaped and sized, and wherein each of said first outer pieces is shaped to engage with at least one of said second outer pieces.

13. The puzzle of claim 12, wherein each of said first outer pieces is shaped to engage with at least one of said inner pieces, and wherein each of said second outer pieces is shaped to engage with at least one of said inner pieces.

14. The puzzle of claim 13, wherein the framing piece comprises a plurality of corner pieces having a plurality of edges, wherein each pair of adjacent edges meets at a right angle, wherein each corner piece has two straight outer edges, and wherein each corner piece is shaped to engage with at least one outer piece.

15. The puzzle of claim 7, wherein each inner piece is in the shape of a double cross.

16. A jigsaw puzzle bearing a complete solved pixelated image, capable of being assembled into a plurality of different arrangements, wherein one arrangement displays the solved pixelated image, the puzzle comprising a plurality of inner pieces adapted to engage one another, wherein the inner pieces are substantially square and are of the same size and comprise only straight edge portions, wherein the inner pieces comprise first sides and second sides complementary to the first sides, wherein each inner piece includes at least one first side and at least one second side, whereby the first side of any one inner piece can be engaged with the second side of any other inner piece and wherein each inner piece comprises an integral plurality of pixels, whereby each pixel is included in only one inner piece.

17. A jigsaw puzzle as claimed in claim 16, wherein each inner piece includes two first sides and two second sides.

18. A jigsaw puzzle as claimed in claim 17, wherein for each inner piece the two first sides oppose one another and the two second sides oppose one another.

19. A jigsaw puzzle as claimed in claim 18, wherein each of the first sides includes a rectangular tab projecting there from and centrally located therealong, and wherein each second side includes a corresponding recess.

20. A jigsaw puzzle as claimed in claim 19, wherein each tab and recess is generally rectangular and has a width greater than its height.

21. The puzzle of claim 20, wherein each inner piece is in the shape of a double cross.

22. A jigsaw puzzle as claimed in claim 21, wherein each tab comprises a rectangular array of pixels.

23. A computer system for displaying and solving an image of a jigsaw puzzle bearing a complete solved pixelated image, comprising display means for displaying an image of a plurality of jigsaw puzzle pieces, processing and memory means for storing and processing information on the jigsaw puzzle and input means for selecting and moving the images of the jigsaw puzzle pieces, wherein the jigsaw puzzle piece images are capable of being assembled into a plurality of arrangements and are removably engageable, wherein one arrangement displays the solved pixelated image, the image of the jigsaw puzzle comprising a plurality of images of inner pieces, each of which comprises a plurality of pixels defined by a plurality of straight grid lines, which pixels are of a size to be immediately apparent and visible to a user, wherein the images of the inner pieces are substantially square and of the same size, and comprise only portions of said grid lines, wherein the inner piece images comprise first sides and second sides complementary to the first sides and wherein each inner piece image includes at least one first side and at least one second side, to enable the first side of any one inner piece image to be engaged in the second side of any other inner piece image.

24. A computer system as claimed in claim 23, wherein each inner piece image includes two first sides and two second sides.

25. A computer system of claim 24, wherein, for each inner piece image, the first sides oppose one another and the second sides oppose one another.

26. A computer system of claim 25, wherein each first side includes at least one tab and each second side includes at least one complementary recess, and wherein each of the tabs and recesses is rectangular.

27. A computer system for displaying and solving an image of a jigsaw puzzle, comprising display means for displaying a plurality of images of jigsaw puzzle pieces, processing and memory means for storing and processing information on the jigsaw puzzle, and input means for selecting and moving the images of the jigsaw puzzle pieces, wherein the image of the jigsaw puzzle comprises a plurality of images of inner pieces, wherein the images of the inner pieces are removably engageable with one another, wherein the image comprises a pixelated image and comprises a complete, solved plurality of pixels arranged on a grid defined by a plurality of sets of parallel lines which intersect one another, wherein each inner piece image comprises an integral number of pixels and edges of each inner piece comprises portions of said lines, whereby each pixel is located solely on a single inner piece.

28. The jigsaw puzzle of claim 27, wherein said pixelated image is comprised of coloured pixels arranged in matrix rows both horizontally and vertically.

29. The jigsaw puzzle of claim 28, wherein each inner piece includes at least one tab and one recess, wherein each tab and recess comprises at least three line portions which are continuous with each other and wherein adjacent line portions meet at an angle and wherein, for each tab and recess, each adjacent parallel line portion comprises portions from different sets of lines.

* * * * *